United States Patent [19]

Kamata et al.

[11] Patent Number: 4,821,555

[45] Date of Patent: Apr. 18, 1989

[54] HYDROPNEUMATIC GUN FOR SETTING BLIND-RIVET NUTS

[75] Inventors: Akira Kamata, Ikoma; Yoshiyuki Kubo; Yasuo Umemura, both of Osaka; Hirohumi Tsuyuguchi, Higashiosaka, all of Japan

[73] Assignee: Lobster Tool Co., Ltd., Osaka, Japan

[21] Appl. No.: 147,383

[22] Filed: Jan. 25, 1988

[51] Int. Cl.[4] ..... B21D 31/00

[52] U.S. Cl. ..... 72/391; 72/114; 72/453.17

[58] Field of Search ..... 72/391, 114, 453.17, 72/453.19, 453.16; 29/243.53, 243.54; 227/130; 91/424, 427

[56] References Cited

U.S. PATENT DOCUMENTS

| | | | |
|---|---|---|---|
| 2,583,733 | 1/1952 | Fischer | 72/114 |
| 4,559,806 | 12/1985 | Schwab | 72/114 |
| 4,612,793 | 9/1986 | Klein | 72/114 |

FOREIGN PATENT DOCUMENTS 53-4674 4/1975 Japan .

*Primary Examiner*—David Jones

*Attorney, Agent, or Firm*—Jordan and Hamburg

[57] ABSTRACT

The present invention relates to improvements in a hydropneumatic gun for setting blind-rivet nuts used for integrally securing, for example, two panels to each other with a nut. In the hydropneumatic gun for setting blind-rivet nuts, an air piston fitted in air cylinder is moved to pressurize oil housed in the gun body, causing an oil piston to be retracted, so that a screw mandrel attached to the oil piston at its tip is retracted to the inner part of the gun body, thereby to exert a deforming force to a sleeve of a nut threadedly mounted on the screw mandrel. The hydropneumatic gun for setting blind-rivet nuts comprises an air motor to be rotated by compressed air, an air motor driving air guide passage, an air motor forward/reverse rotation direction changeover mechanism for switching the rotation direction of the air motor, and a power transmission mechanism for transmitting an air motor driving force to the screw mandrel. According to the present invention, a series of operations of the screw mandrel such as forward rotation, stop of the rotation, retraction, reverse rotation and advancement can be carried out smoothly and sequentially.

3 Claims, 13 Drawing Sheets

HYDROPNEUMATIC GUN FOR SETTING BLIND-RIVET NUTS

BACKGROUND OF THE INVENTION a. Field of the Art

The present invention relates to improvements in a hydropneumatic gun for setting blind-rivet nuts used for integrally securing, for example, two panels to each other with a nut, and more particularly to improvements in its maneuverability. The present invention can be utilized in the field of production technology of such tools.

b. Prior Art

An electric gun for setting blind-rivet nuts is known and is generally used in the following way. A nut having an internal thread in the inner periphery of a flanged sleeve is inserted and fitted in, for example, mounting holes in two panels connected to each other, and a screw mandrel of the electric gun is threadedly connected to the nut. While pressing the flange of the nut to the lateral sides of the panel mounting holes, the screw mandrel is retracted toward the inner side of the gun body to outwardly expand and deform the nut sleeve. Thus, the two panels are secured to each other as pressed and held between the deformed sleeve and the flange (for example, Japanese Patent Publication No. 53-4674).

The screw mandrel for deforming the nut is first rotated forward for threadedly mounting the nut on the screw mandrel, and then pulled, without being rotated, in order to deform the nut, and then rotated reversely, causing the screw mandrel to be separated from the nut secured to panels or the like. These operations must to be automatically and sequentially carried out simultaneously with the securing of the nut to panels or the like. Therefore, it is very important to assure smooth power transmission and changeover for such operations. It is also important that these operations are securely carried out corresponding to the respective steps of securing the nut to panels or the like.

OBJECTS OF THE INVENTION

It is an object of the present invention to provide a hydropneumatic gun for setting blind-rivet nuts to be driven by compressed air, in which the automatic and sequential operations above-mentioned are carried out smoothly and securely to improve its maneuverability and working efficiency.

SUMMARY OF THE INVENTION

The present invention provides a hydropneumatic gun for setting blind-rivet nuts in which an air piston fitted in an air cylinder is moved to pressurize oil housed in the gun body, causing an oil piston to be retracted, so that a screw mandrel attached to the oil piston at its tip is retracted to the inner side of the gun body, thereby to exert a deforming force to a sleeve of a nut threadedly mounted on the screw mandrel. This hydropneumatic gun for setting blind-rivet nuts comprises:

an air motor to be rotated by compressed air in the gun body;

an air motor driving air guide passage between the air motor and a compressed air supply port in the gun body;

an air motor rotation direction changeover mechanism for switching the rotation direction of the air motor;

a power transmission mechanism between the air motor and the screw mandrel for transmitting an air motor forward/reverse rotation driving force to the screw mandrel;

an air piston moving air guide passage between the compressed air supply port and an air guide hole in an air cylinder at the air piston moving side;

a spool slidably fitted in a communication hole communicating with the air piston moving air guide passage for opening/closing the air piston moving air guide passage;

a spool controlling air guide chamber between the communication hole and the compressed air supply port for moving the spool in the communication hole by compressed air in such direction as to close the air piston moving air guide passage;

a discharge passage between the air guide chamber and a compressed air discharge port in the gun body in the vicinity of the power transmission mechanism for discharging compressed air guided in the air guide chamber; and a clutch of the power transmission mechanism disposed in the discharge passage, the clutch also serving as a member for opening/closing the discharge passage, the discharge passage being adapted to be opened when the clutch is rotated to a predetermined angle position by a predetermined turning torque.

Such arrangement of the present invention assures a smooth and sequential achievement of a series of operations of the screw mandrel such as forward rotation, stop of the rotation, retraction, reverse rotation and advancement.

This facilitates the threaded mounting of a nut on the screw mandrel during forward rotation thereof. Thereafter, when a flange of the nut threadedly mounted is pressed to the lateral side of a mounting hole, the nut is secured to relatively advance the screw mandrel. The flange is then secured to the gun body to stop the rotation of the screw mandrel. This causes the clutch of the power transmission mechanism to be rotated to a predetermined angle position. At this time, the communication hole in the clutch communicates with the air discharge passage including the spool controlling air guide chamber and the air discharge port in the gun body, thereby to release the control of the spool. The spool causes the air piston moving air guide passage to be opened to supply compressed air into the air cylinder.

The compressed air thus supplied in the air cylinder moves the air piston to pressurize the oil in the gun body. Then, the oil piston and the screw mandrel attached thereto are simultaneously retracted to deform the nut. When the oil piston is retracted to a predetermined retracted position in order to perfectly achieve the nut deformation, the air motor rotation direction changeover mechanism is operated to rotate the air motor reversely. Then, the clutch is returned to the original position to close the air discharge passage. Accordingly, the spool in the air piston moving air guide passage is returned to the original position by compressed air to close this air guide passage. Thus, the moving action to the air piston is released. The air piston is returned with the advancement of the oil piston by a returning spring. While the air motor driving air guide passage is maintained as opened during such returning of the air piston, the air motor can be rotated reversely. Accordingly, the screw mandrel can be removed from the nut secured in the mounting hole.

When the air motor driving air guide passage is closed after completion of these operations, the changeover spool of the rotation direction changeover mechanism is returned to the original position by a returning spring. Thus, the air motor driving air guide passage is so switched as to rotate the air motor forward.

According to the present invention, a series of operations of the screw mandrel such as forward rotation, stop of the rotation, retraction, reverse rotation and advancement can be achieved smoothly and sequentially. This remarkably improves the maneuverability and working efficiency of the hydropneumatic gun for setting blind-rivet nuts to be driven by compressed air.

DETAILED DESCRIPTION OF PREFERRED EMBODIMENTS

The following description will discuss in detail embodiments of the present invention, by way of example, with reference to FIGS. 1 to 15.

Figure 1:
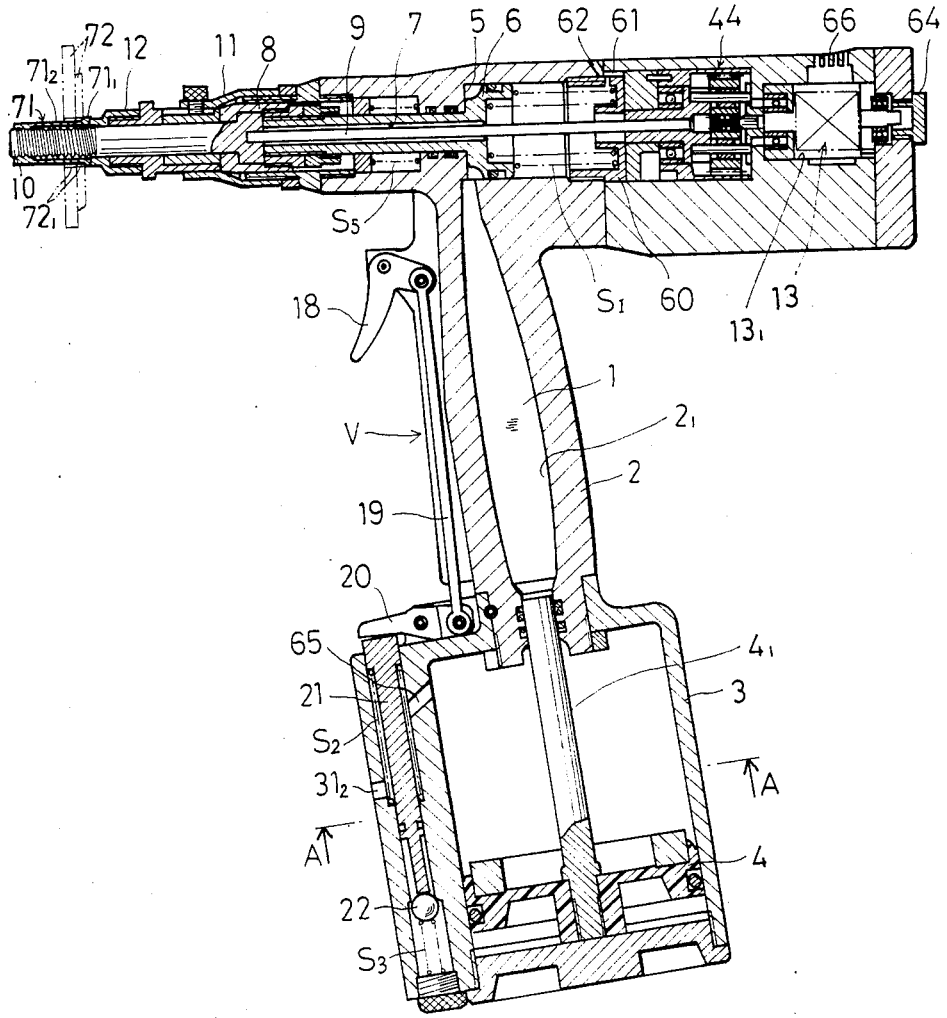
FIG. 1 is a general longitudinal section view in front elevation of a hydropneumatic gun for setting blind-rivet nuts in accordance with a first embodiment of the present invention.
Figure 2:
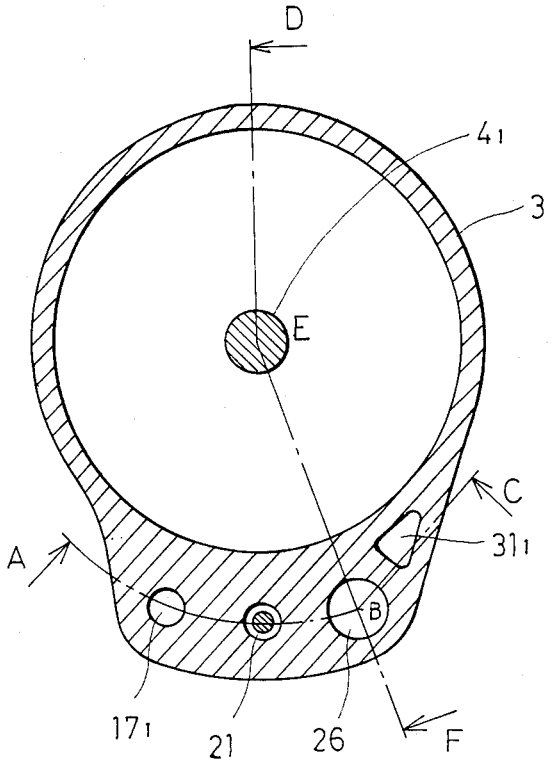
FIG. 2 is a transverse section view in end elevation taken along the line A—A in FIG. 1.
Figure 3:
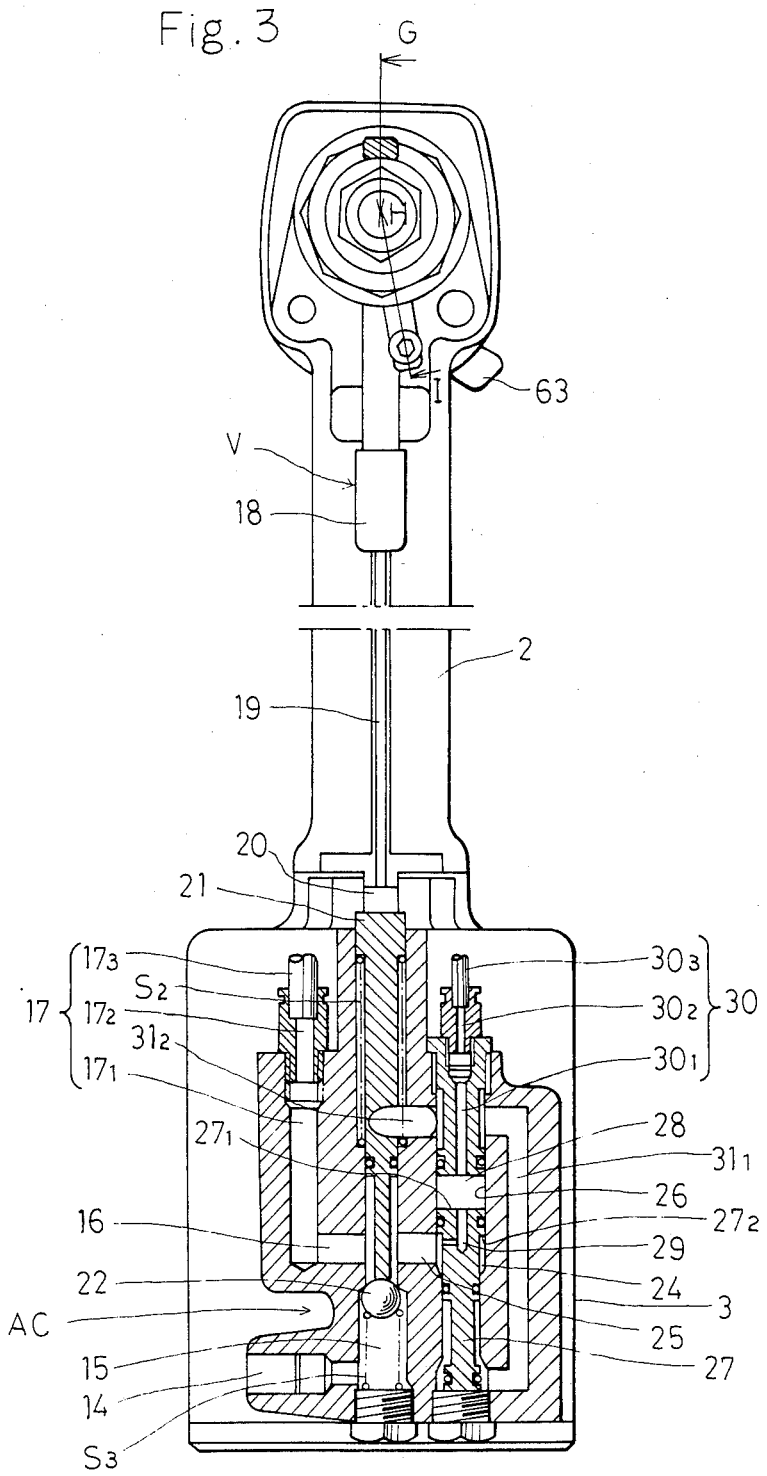
FIG. 3 is a left-hand side view in longitudinal section taken along the line A-B-C in FIG. 2.
Figure 4:
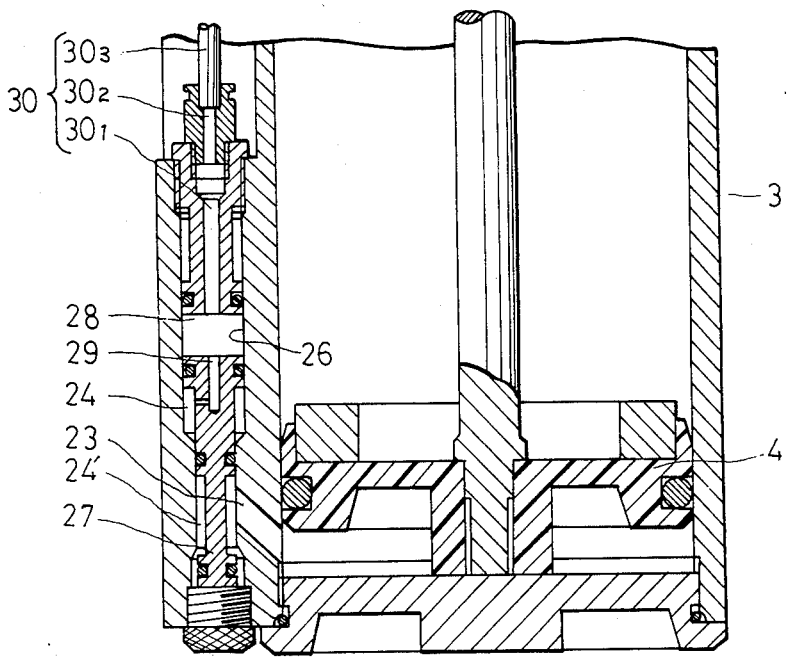
FIG. 4 is a longitudinal section view, with portions omitted, taken along the line D-E-F in FIG. 2.

FIGS. 1 to 3 generally show a hydropneumatic gun for setting blind-rivet nuts in accordance with the present invention, which comprises:

a body frame 2 including an oil housing $2_1$ for housing oil 1;

an air cylinder 3 disposed under the frame 2;

an air piston 4 for pressurizing the oil 1 in the air cylinder 3;

an oil cylinder 5 communicating with the oil housing $2_1$ at the upper portion of the frame 2;

an oil piston 6 disposed in the oil cylinder 5;

a returning spring $S_1$ for advancing the oil piston 6;

a pivot member 8 of a screw mandrel, to be discussed later, secured to the front end of the oil piston 6;

a turning force transmission square shaft 9 having a square section insertingly fitted in a through-hole 7 in the axis of the oil piston 6 such that the shaft 9 is rotatable in the circumferential direction;

the screw mandrel 10 engaged with the front end of the square shaft 9 such that the screw mandrel 10 is rotatable integrally with the square shaft 9 in the circumferential direction;

a connector 11 mounted on the body frame 2 at the front end thereof; and a nose piece 12 mounted on the connector 11 at the front end thereof.

An air motor 13 for rotatingly driving the square shaft 9 is disposed at the rear portion of the square shaft 9. The air cylinder unit 3 includes an air control mechanism AC having a compressed air supply port 14. An air motor driving air guide passage 17 is formed between the air motor 13 and the compressed air supply port 14 through an air passage 15 having a valve seat and an air branch passage 16.

The air guide passage 17 has a communication hole $17_1$ communicating with the supply port 14 (FIG. 3), a passage $17_2$ and an air hose $17_3$. An openable valve mechanism V is disposed between the air guide passage 17 and the air motor 13.

This mechanism V has:

a trigger 18 at the front side of the frame 2;

a connecting rod 19 pivotally connected to the trigger 18;

a lever 20 having a base end pivoted to the connecting rod 19 and an intermediate portion pivoted to the air cylinder 3 at the upper portion thereof;

a pusher 21 slidably inserted into an insertion hole in the air control mechanism AC while the upper end of the pusher 21 is pressure-contacted to the underside of the tip of the lever 20 by a spring $S_2$; and a valve body 22 pressure-contacted to the valve seat in the air passage 15 by a spring $S_3$.

The valve mechanism V normally closes a passage between the compressed air supply port 14 and the air guide passage 17 by the valve body 22 biased by the spring $S_3$. When the trigger 18 is pulled toward the operator, the pusher 21 is lowered through the connecting rod 19 and the lever 20 against the spring load of the spring $S_2$. The lower end of the pusher 21 pushes down the valve body 22 against the spring load of the spring $S_3$, causing the compressed air supply port 14 to communicate with the air guide passage 17.

An air piston moving air guide passage 24 is formed between the air supply port 14 and an air guide hole 23 (FIG. 4) in the air cylinder 3 at the air piston 4 moving side. The air guide passage 24 communicates with the supply port 14 through the passage 15 and the other air branch passage 25. A spool 27 for opening and closing the air guide passage 24 is slidably fitted in a communication hole 26 which communicates with the air guide passage 24. A spool controlling air guide chamber 28 is formed between the communication hole 26 and the supply port 14 through an air flowing hole 29. This air guide chamber 28 is adapted to move the spool 27 by air in such direction as to close the air guide passage 24. Air is guided from the air supply port 14 into the air guide chamber 28 through the air flowing hole 29 in the spool 27. The air thus guided into the air guide chamber 28 pushes the spool 27 downward to close the passage 24.

Due to the pressure of air supplied from the other air branch passage 25, the spool 27 is pushed in such direction as to close the passage 24. More specifically, the pushing force corresponds to the areas of the top surface $27_1$ and the underside surface $27_2$ of the large-diameter portion of the spool 27. Accordingly, when air is guided into the air guide chamber 28, the pushing force applied to the top surface $27_1$ is greater than that applied to the underside $27_2$. Therefore, the spool 27 receives a pushing force in such direction as to close the passage 24.

FIG. 3 shows an air discharge passage 30 for discharging air in the spool controlling air guide chamber 28. This air discharge passage 30 is disposed between the air guide chamber 28 and an air discharge port in the gun body in the vicinity of a power transmission mechanism to be discussed later. The air discharge passage 30 includes passages $30_1$ and $30_2$ which communicate with the air guide chamber 28, and an air hose $30_3$. FIG. 3 also shows a discharge passage $31_1$ and a discharge hole $31_2$ for discharging the air in the air cylinder 3 to the outside of the gun body.

Disposed in the air motor driving air guide passage 17 is an air passage changeover spool of a rotation direction changeover mechanism 32 for switching the rotation direction of the air motor 13, to be discussed later.

Figure 5:
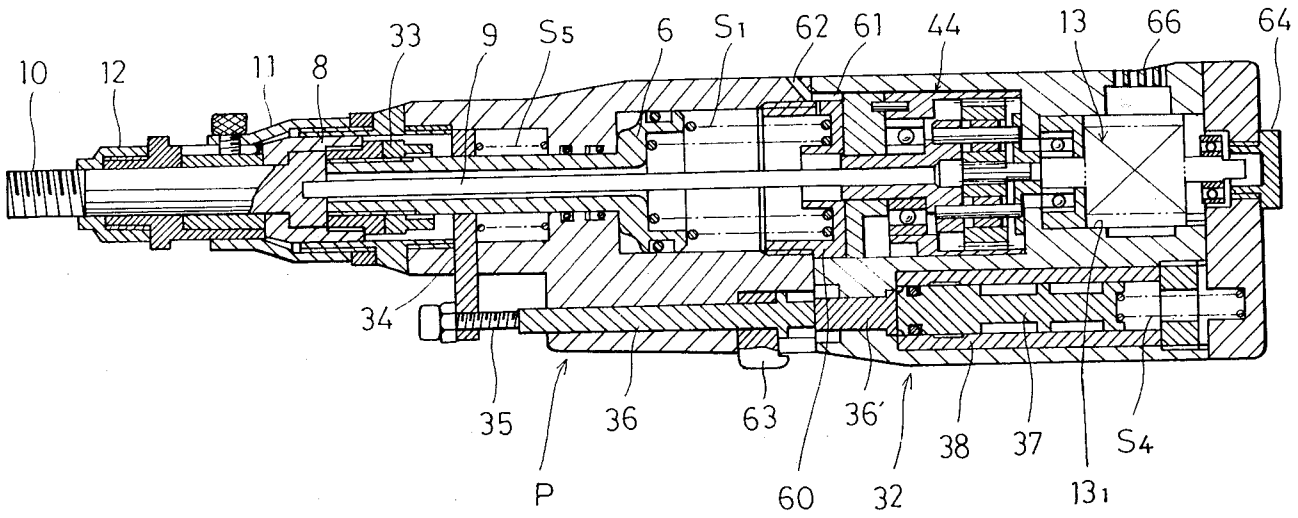
FIG. 5 is a section view taken along the line G-H-I in FIG. 3.

As shown in FIG. 5, the mechanism 32 has a push member P and an air passage changeover spool 37 disposed in the air guide passage 17. The push member P includes: an adapter nut 33 threadedly connected to the oil piston 6 at the tip thereof; a guide plate 34 fittingly inserted into the oil piston 6 at the rear side of the adapter nut 33 such that the guide plate 34 is movable back and forth; an adjusting screw 35 threadedly connected to the guide plate 34 at the projection thereof; a push rod 36 transversely movably inserted in the gun body such that the tip of the push rod 36 can come in contact with the tip of the adjusting screw 35; and a divided push rod 36' transversely movably inserted in the gun body while the rod 36' is in contact with the rear end of the push rod 36.

The spool 37 is disposed such that the tip thereof comes in contact with the rear end of the divided push rod 36'. The push member P is normally biased to the position shown in FIG. 5 by a returning spring $S_4$.

Figure 6A:
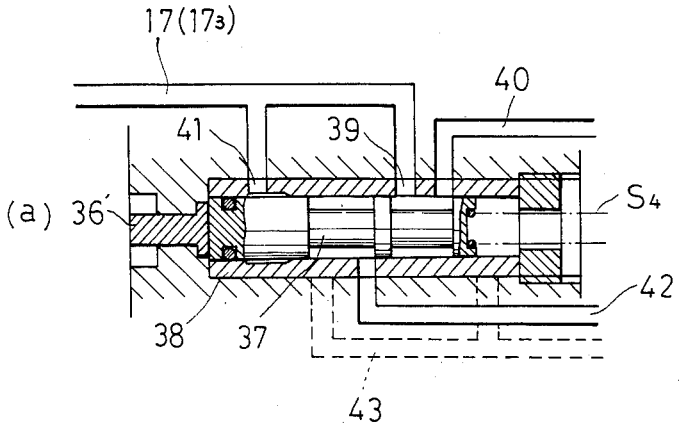
FIG. 6 (*a*) and (*b*) are views illustrating the operation of a changeover spool in an air guide passage.
Figure 6B:
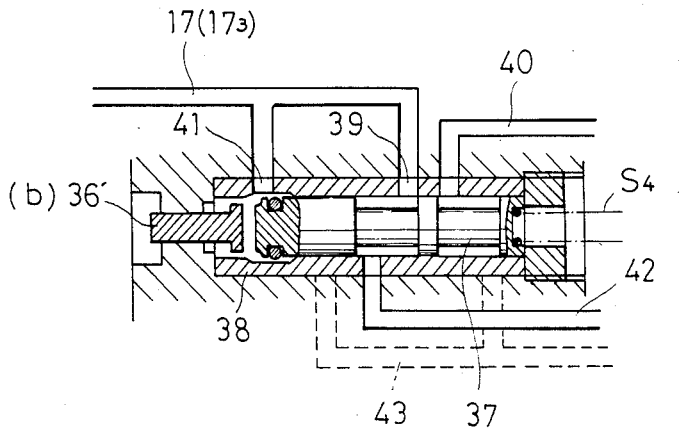

Thus, the air passage changeover spool 37 is fittingly inserted in a bushing 38 communicating with the air guide passage 17 as shown in FIG. 6 (*a*) and (*b*), and is normally biased by the returning spring $S_4$ in such direction as to rotate the air motor 13 forward. The following describes how to switch the air passage by this spool 37.

As shown in FIG. 5 and FIG. 6 (*a*), the changeover spool 37 is normally moved forward by the spring load of the spring $S_4$. Air supplied through the passage 17 flows in an air guide hole 39 in the bushing 38 and an air delivery hole 40 which communicates with a forward rotation side air jet port (not shown) in a housing space $13_1$ for housing the air motor 13. The air is then jetted into the housing space $13_1$. Thus, the air is a driving force for rotating the air motor 13 forward. When the oil piston 6 is retracted by the oil pressure, the adapter nut 33 of the push member P is also retracted to retract the guide plate 34 against the spring load of a spring $S_5$. Accordingly, the adjusting screw 35, the push rod 36 and the divided push rod 36' are also retracted, and the changeover spool 37 is pushed rearward by the rear end of the divided push rod 36'.

At this time, when the front end of the changeover spool 37 is retracted up to an air guide hole 41 in the bushing 38 at the front thereof as shown in FIG. 6 (*b*), air is guided from this hole 41 into the bushing 38 to securely move the changeover spool 37 rearward. While the changeover spool 37 is moved rearward, the spool 37 causes the air delivery hole 40 to communicate with an exhaust hole 43 and also causes the air guide hole 39 to communicate with an air delivery hole 42 which communicates with a reverse rotation side air jet hole (not shown) in the air motor housing space $13_1$. Thus, the air is a driving force for rotating the air motor 13 reversely.

Disposed between the air motor 13 and the screw mandrel 10 is a power transmission mechanism 44 for transmitting a forward/reverse rotation driving force of the air motor 13 to the screw mandrel 10.

Figure 7:
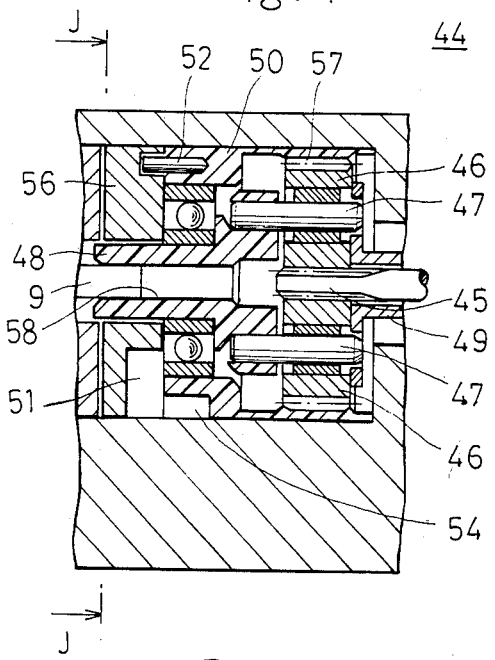
FIG. 7 is a longitudinal section view in front elevation of main portions of a power transmission mechanism.
Figure 8:
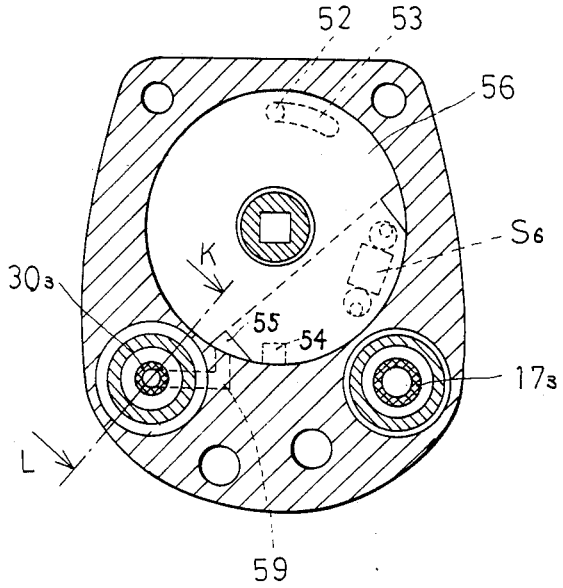
FIG. 8 is a section view taken along the line J—J in FIG. 7.
Figure 9:
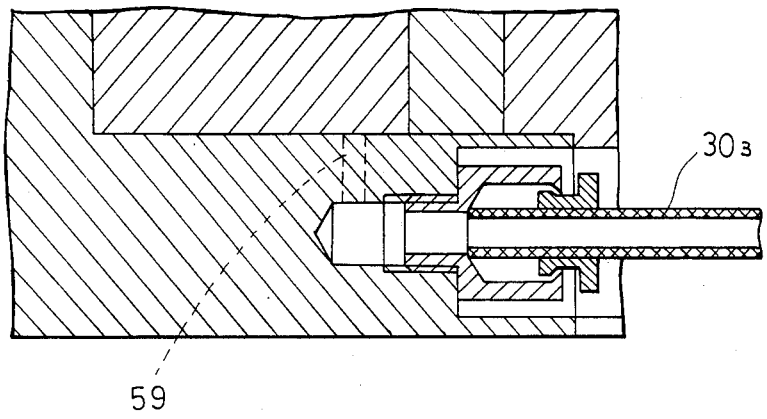
FIG. 9 is an enlarged section view, with portions omitted, taken along the line K-L in FIG. 8.
Figure 10A:
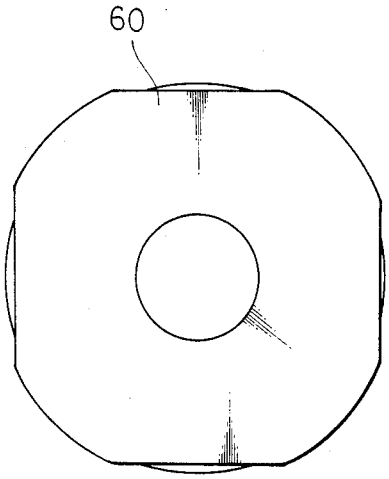
FIG. 10 (*a*) and (*b*) are a right-hand side view and a front view, with portions broken away, of a frame cap.
Figure 10B:
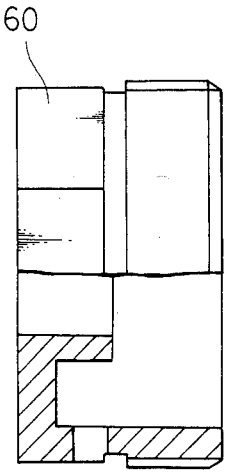

As shown in FIGS. 7 and 8, this mechanism 44 includes:

a plurality of planetary gears 46 which mesh with a transmission gear 45 disposed at the end of the rotary shaft of the air motor 13;

pivotal support members 48 and 49 of the gears 46 for pivotally supporting the gears 46 through pins 47 at both front and back positions of the gears 46;

a clutch 50 fitted to the gears 46 at their peripheries;

a returning spring $S_6$ for rotating the clutch 50 in a predetermined circumferential direction; and a clutch regulating plate 56 having a housing chamber 51 of the spring $S_6$, a slot 53 into which a knock pin 52 extending from the clutch 50 is fitted, and a through-hole 55 which communicates with a communication hole 54 in the clutch 50 as necessary.

The clutch regulating plate 56 covers the clutch 50 in the arrangement shown in FIGS. 7 and 8.

Both pivotal support members 48 and 49 are rotatable simultaneously with the rotation of the gears 46. The clutch 50 is resiliently hooked on the regulating plate 56 by the spring $S_6$. Accordingly, while turning on their axes, the planetary gears 46 are normally guided by and rotated around an internal gear 57 in the inner periphery of the clutch 50. The front pivotal support member 48 is provided in the axis thereof with a square hole 58 with which the rear end of the square shaft 9 is engaged. Accordingly, the forward/reverse rotation force of the air motor 13 is transmitted to the front screw mandrel 10 through the transmission gear 45, the planetary gears 46, the pins 47, the pivotal support member 48 and the square shaft 9.

The air hose $30_3$ of the air discharge passage 30 communicates with the through-hole 55 in the regulating plate 56 through an air discharge hole 59. The through-hole 55 is adapted to communicate with the communication hole 54 in the clutch 50 when the clutch 50 is switched. Accordingly, when the clutch 50 is switched, the air hose $30_3$ communicates with an air discharge port 62 in the gun body through a passage 61 formed between a frame cap 60 in the gun body and the inner wall thereof.

The following paragraphs will discuss a series of operations of the hydropneumatic gun for setting blind-rivet nuts in accordance with the embodiment above-mentioned.

The trigger 18 is pulled to open the valve body 22, causing the compressed air supply port 14 to communicate with the air guide passage 17. Air is then supplied to the air motor 13 to rotate the air motor 13 forward.

Then, the screw mandrel 10 is also rotated forward. In such state, a nut 71 is threadedly mounted on the screw mandrel 10. The nut 71 is fittingly inserted into mounting holes $72_1$ in two panels 72, and a flange $71_1$ of the nut 71 is pressed to the lateral sides of the mounting holes $72_1$ to stop the rotation of the nut 71. Then, the screw mandrel 10 (the gun body side) is relatively advanced. Such advancement causes the flange $71_1$ of the nut 71 to be securely connected to the nose piece 12. Then, the screw mandrel 10 is locked to stop its rotation. However, since the forward rotation of the air motor 13 is continued, the transmission gear 45 turns the planetary gears 46 on their axes. Accordingly, the clutch 50 is rotated forward up to a predetermined angular position against the spring load of the spring $S_6$. This predetermined angular position refers to the position where the knock pin 52 in FIG. 8 regulates the rotation of the clutch 50. When the clutch 50 is rotated to this position, the communication hole 54 in the clutch 50 communicates with the through-hole 55, causing the air hose $30_3$ in the air discharge passage 30 to communicate with the discharge port 62.

Due to such communication of the air hose $30_3$ with the discharge port 62, air guided into the air guide chamber 28 is discharged to the outside of the gun body through the air discharge passage 30. Accordingly, the air pressure in the air guide chamber 28 is decreased to release the control of the spool 27. Therefore, the pressure of air supplied through the supply port 14 and the branch passage 25 is received by the underside $27_2$ of the large-diameter portion of the spool 27. The spool 27 is then pushed upward, causing the air branch passage 25 to communicate with an air guide passage 24'. Accordingly, the air is supplied into the air cylinder 3 through the passage 24' and the cylinder air guide hole 23 to move the air piston 4. The piston rod $4_1$ enters the oil housing $2_1$ to pressurize the oil 1 therein. Such pressurization of the oil 1 causes the oil piston 6 to be retracted against the spring load of the returning spring $S_1$. However, the pivot member 8 at the front of the oil piston 6 retracts the screw mandrel 10 simultaneously with the retraction of the oil piston 6. Therefore, the sleeve $71_2$ of the nut 71 is outwardly expanded and deformed to secure the panels 72 between the flange $71_1$ and the deformed sleeve. Thus, deformation of the nut 71 can be achieved. Such deformation of the nut 71 is made while the oil piston 6 is moved to a predetermined rear portion by the oil pressure.

As discussed earlier, when the oil piston 6 is retracted to deform the nut 71, the air passage changeover spool 37 is retracted by the push member P to rotate the air motor 13 reversely. When the air motor 13 is reversely rotated, the clutch 50 is returned to the original position by the spring load of the returning spring $S_6$ and the reverse rotation of the planetary gears 46 to close again the air discharge passage 30. Accordingly, air is guided again into the air guide chamber 28 to push the spool 27 downward. This cuts off the communication of the air branch passage 25 with the passage 24'. This eliminates the working force of moving the air piston 4 to stop the pressurization of the oil 1 by the piston rod $4_1$. Therefore, the oil piston 6 is returned forward by the spring load of the returning spring $S_1$. However, while the valve body 22 is pushed down to supply air to the air guide hole 41 in the front of the bushing 38 of the air motor rotation direction changeover mechanism 32, the spool 37 is held at its current position by the air pressure to continue the reverse rotation of the air motor 13. Accordingly, while being reversely rotated, the screw mandrel 10 is retracted and separated from the nut 71 which is secured to the mounting holes $72_1$ in the panels 72. Thereafter, when the finger is released from the trigger 18 to push up the valve body 22, the changeover spool 37 is returned to the original forward position by the spring load of the returning spring $S_4$. Consequently, the push member P is also returned to the original position, thus providing the normal state.

FIG. 5 also shows a grip 63 attached to the rear portion of the push rod 36 of the push member P. If the threaded connection of the nut 71 to the screw mandrel 10 was not properly made, the grip 63 can be pulled to manually retract the push member P. The air motor 13 can be emergently rotated reversely to remove the nut 71.

A screw lid 64 is removably attached to the rear end of the air motor housing $13_1$. If the air motor 13, the square shaft 9, the screw mandrel 10 or the like cannot be rotated or are defectively rotated due to unexpected causes, the screw lid 64 can be removed and the rotary shaft of the air motor 13 can be manually rotated with a screwdriver or the like to provide normal conditions. FIG. 1 also shows an air discharge passage 65 in the air cylinder 3, and a discharge pipe 66 for discharging surplus air supplied into the casing of the air motor 13.

In the embodiment above-mentioned, the air motor rotation direction changeover mechanism 32 includes the air passage changeover spool 37 in the gun body, the returning spring $S_4$ disposed at the rear side of the spool 37 and the spool push member P coacting with the oil piston 6. The mechanism normally advances the spool 37 by the returning spring $S_4$, causing the air passage in the spool 37 to communicate with the passage of the air motor 13 at its forward rotation side. When the oil piston 6 is retracted, the push member P retracts the spool 37, causing the air passage in the spool 37 to communicate with the passage of the air motor 13 at its reverse rotation side. Such arrangement can reduce the space required for housing the spool 37, thus enabling the hydropneumatic gun for setting blind-rivet nuts to have a compact design in its entirety.

If the threaded connection of the nut 71 to the screw mandrel 10 was not properly made, the spool push member P can be manually retracted to rotate the air motor 13 reversely to remove the nut 71.

FIGS. 11 to 15 shows a second embodiment of the present invention, in which like members are designated by like numerals increased by 100 which are used in FIGS. 1 to 10.

In the second embodiment, a square shaft 109 is engaged with a screw mandrel 110 through a square shaft piece $109_1$ secured to the front end of the square shaft 109.

Disposed between an air motor 113 and a compressed air supply port 114 is an air motor driving air guide passage 117 through an air branch passage 116.

Disposed in the air guide passage 117 is a valve mechanism V for opening and closing the passage 117, of which valve body 122 is normally biased by the spring load of a spring $S_2$ in such direction as to close the passage 117. When the valve body 122 is pushed against the spring load of the spring $S_2$ in the direction shown by an arrow in FIG. 11, the passage 117 is opened, causing the air supply port 114 to communicate with the air motor 113 through the passage 117 to rotate the air motor 113.

Also disposed in the air guide passage 117 is a rotation direction changeover mechanism 132 for switching the rotation direction of the air motor 113 by a predetermined pressing force to oil 101.

The mechanism 132 includes a bushing 138 communicating with the air guide passage 117, an air passage changeover spool 137 fittingly inserted in the bushing 138, a returning spring $S_4$ for biasing the spool 137 to the forward rotation side of the air motor 113 and a spool $137_1$ for pushing the spool 137 to the reverse rotation side of the air motor 113 by a predetermined pressing force to the oil 101. The following paragraphs will discuss how the air passage is switched by the mechanism 132.

Figure 11:
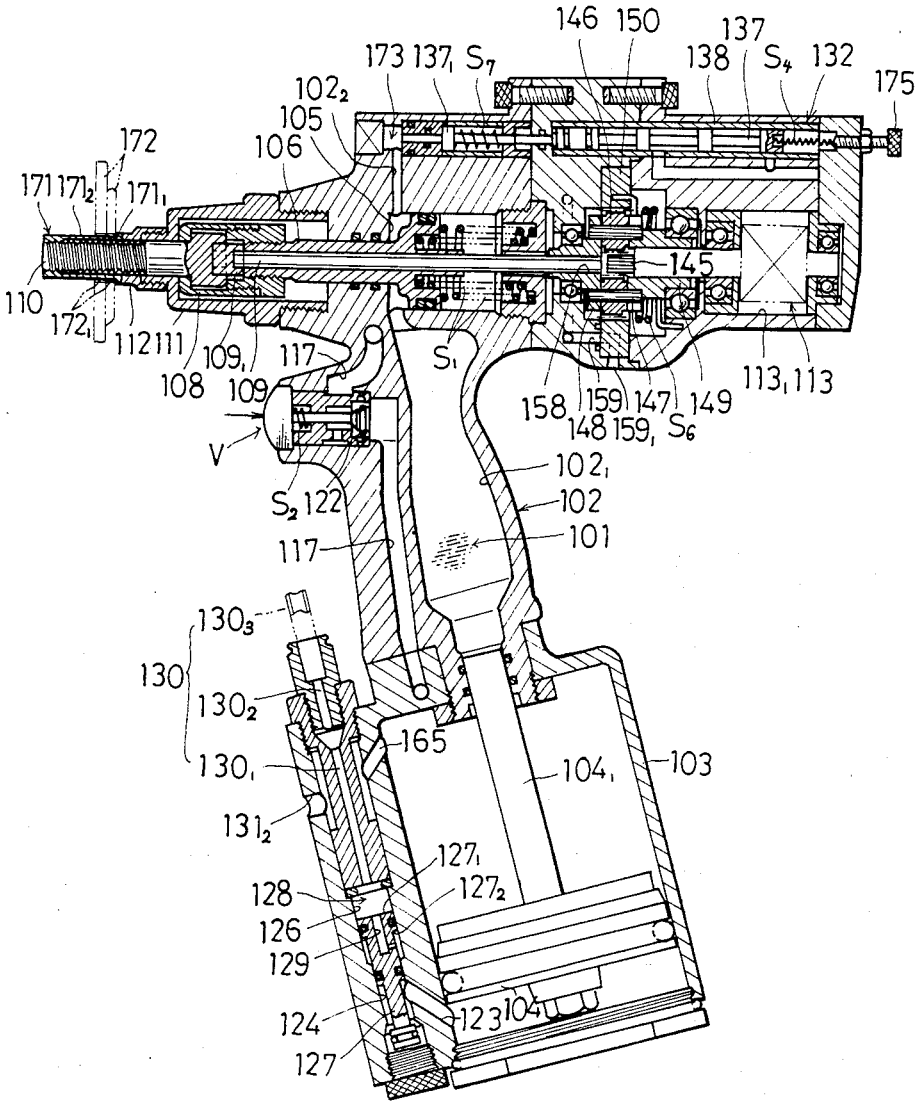
FIG. 11 is a general longitudinal section view, with portions broken away, of a hydropneumatic gun for setting blind-rivet nuts in accordance with a second embodiment of the present invention.
Figure 12:
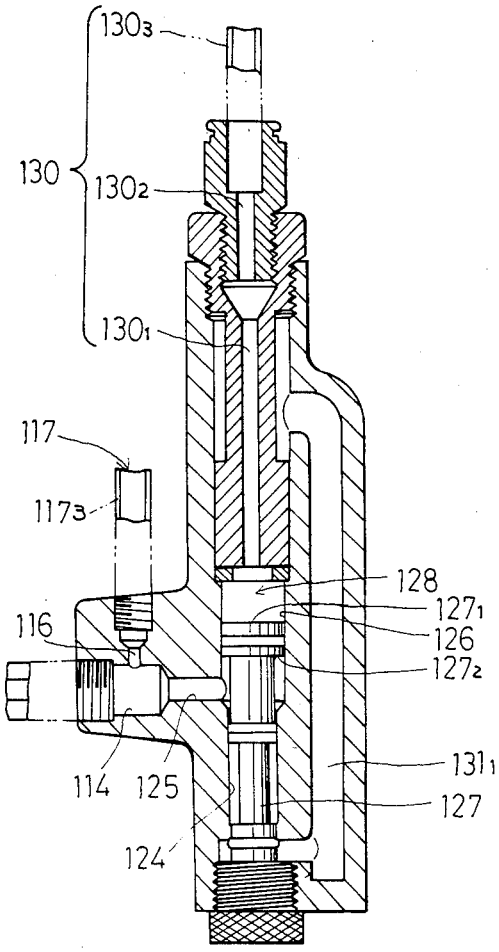
FIG. 12 is a longitudinal section view of a compressed air supply port.
Figure 13:
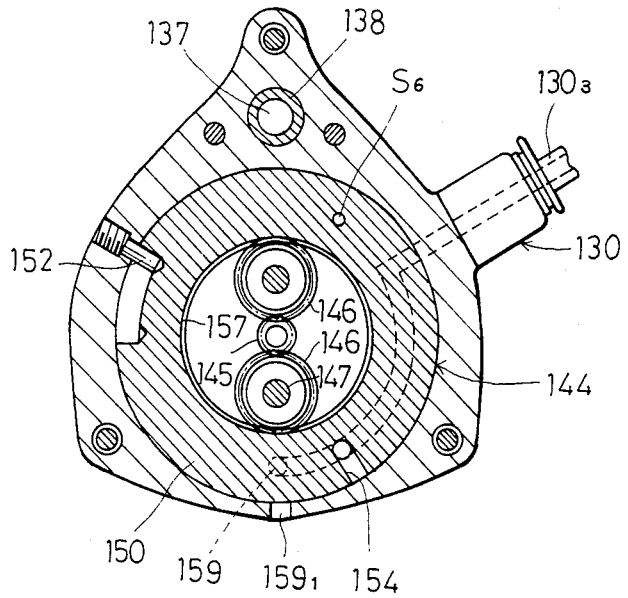
FIG. 13 is a longitudinal section view of a power transmission mechanism.
Figure 14:
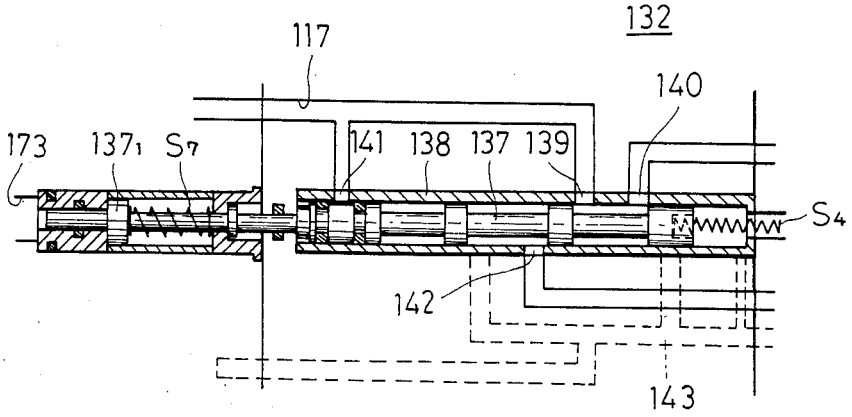
FIGS. 14 and 15 are views showing the operation of a forward/reverse rotation direction changeover mechanism.
Figure 15:
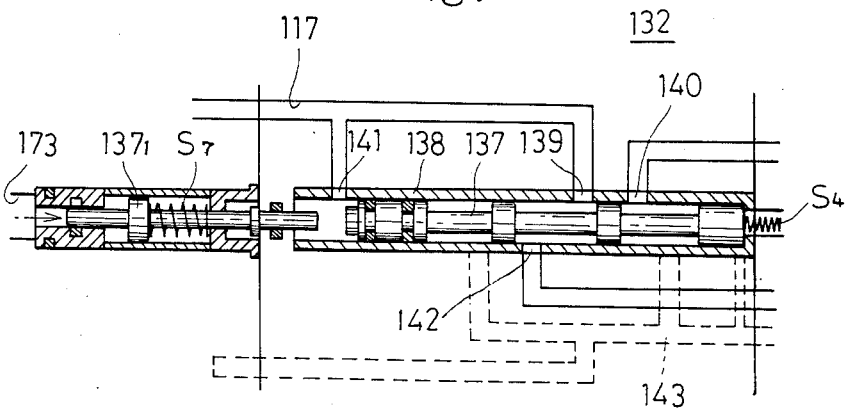

As shown in FIGS. 11 and 14, the changeover spool 137 is normally moved forward by the spring load of the spring $S_4$ and the pushing spool $137_1$ is normally moved forward by the spring load of the returning springs $S_4$ and $S_7$. Air supplied through the passage 117 passes through an air guide hole 139 in the bushing 138 and an air delivery hole 140 which communicates with a forward rotation side air jet port (not shown) in an air motor housing space $113_1$. The air is then jetted in the housing space $113_1$. Thus, the air is a driving force for rotating the air motor 113 forward. As discussed later, when a pressing force on the oil 101 exceeds a predetermined value, the pushing spool $137_1$ is moved rearward against the spring load of the returning springs $S_7$ and $S_4$. The changeover spool 137 is therefore pushed rearward as shown in FIG. 15. At this time, however, when the front end of the changeover spool 137 is retracted to an air guide hole 141 in the front of the bushing 138, air is guided from the guide hole 141 into the bushing 138 to securely move the changeover spool 137 rearward. While the changeover spool 137 is moved rearward, the spool 137 causes the air delivery hole 140 to communicate with an exhaust hole 143 and also causes the air guide hole 139 to communicate with an air delivery hole 142 which communicates with a reverse rotation side air jet hole (not shown) in the air motor housing space $113_1$. Accordingly, the air thus supplied is a driving force for rotating the air motor 113 reversely.

In a power transmission mechanism 144, a clutch 150 is resiliently hooked on the gun body through a spring $S_6$.

A spool 127 controls air guide chamber 128, and an air discharge port $159_1$ in the vicinity of the power transmission mechanism 144. Disposed between the air guide chamber 128 and the air discharge port $159_1$ is an air discharge passage 130 for discharging air in the air guide chamber 128. Through the passage 130, the air guide chamber 128 communicates with an air delivery hole 159 in the front of the clutch 150 of the power transmission mechanism 144. The air delivery hole 159 is adapted to communicate with an air discharge port $159_1$ through a communication hole 154 in the clutch 150 when the clutch 150 is rotated to a predetermined angular position by a predetermined turning torque to be discussed later.

Due to the communication of the air delivery hole 159 with the discharge port $159_1$, air guided is provided in the air guide chamber 128 is discharged outside of the gun body through the air discharge passage 130. This decreases the pressure of air in the air guide chamber 128 to release the control on the spool 127, causing the spool 127 to be pushed in such direction as to open a passage 124. When the passage 124 is opened, air is supplied into an air cylinder 103 to move the air piston 104. A piston rod $104_1$ is pushed into an oil housing $102_1$ to pressurize the oil 101 therein. This retracts an oil piston 106 and the screw mandrel 110 at the same time, enabling a sleeve $171_2$ of a nut 171 to be outwardly expanded and deformed.

Through an oil passage $102_2$, an oil cylinder 105 communicates with a guide chamber 173 for guiding a working oil for the pushing spool $137_1$ in the air motor rotation direction changeover mechanism 132. Accordingly, a predetermined oil pressure as above-mentioned is applied to this oil guide chamber 173. Upon completion of deformation of the nut 171, such oil pressure causes the pushing spool $137_1$ to be moved rearward, and the air motor 113 is reversely rotated as mentioned earlier.

A bolt 175 is disposed for adjusting the spring-load of the returning spring $S_4$.

What is claimed is:

1. In a hydropneumatic gun for setting blind-rivet nuts, including a gun body having oil therein, an air cylinder coupled to the gun body, an oil piston in said gun body, a screw mandrel attached to a tip of said oil piston for threadedly receiving a sleeve of a nut, a compressed air supply port in said gun body, an air piston movably fitted in the air cylinder for pressurizing said oil in the gun body upon movement of said air piston, said oil piston being mounted to be retracted by said pressurizing of said oil to retract said screw mandrel to the inner part of the gun body and exert a deforming force on said sleeve of said nut threadedly, the improvement wherein said hydropneumatic gun for setting blind-rivet nuts comprises:

an air motor mounted to be rotated in said gun body by compressed air from said port;

an air motor driving air guide passage between said air motor and said compressed air supply port;

an air motor forward/reverse rotation direction changeover mechanism in said motor driving air guide passage for switching the rotation direction of said air motor;

a power transmission mechanism coupled between said air motor and said screw mandrel for transmitting forward and reverse rotation driving forces from said air motor;

an air guide hole in said air cylinder at the air piston moving side, and an air piston moving air guide passage between said compressed air supply port and said air guide hole;

a communication hole communicating with said air piston moving air guide passage, and a spool slidably fitted in a said communication hole for opening and closing said air piston moving air guide passage;

a spool controlling air guide chamber between said communication hole and said compressed air supply port for moving said spool in said communication hole by compressed air from said port in such direction as to close said air piston moving air guide passage; and a discharge passage between said air guide chamber and a compressed air discharge port in the vicinity of said power transmission mechanism in said gun body for discharging compressed air guided in said air guide chamber;

said power transmission mechanism having a clutch disposed in said discharge passage, whereby said clutch also serves as a member for opening and closing said discharge passage and said discharge passage is opened when said clutch is rotated to a predetermined angular position by a predetermined turning torque from said air motor.

2. A hydropneumatic gun for setting blind-rivet nuts as set forth in claim 1, wherein the air motor forward-/reverse rotation direction changeover mechanism comprises:

an air passage changeover spool in the gun body, said air passage changeover spool having a rear side;

a returning spring at said rear side of said air passage changeover spool;

a spool push member mounted to coact with said oil piston; and a spool air passage;

said air passage changeover spool being mounted to be moved by said returning spring in a direction to cause said spool air passage to communicate with a forward rotation passage of said air motor forward rotation side;

said spool being mounted to be retracted by said push member when said oil piston is retracted to cause said spool air passage to communicate with a reverse rotation side air passage of said air motor.

3. A hydropneumatic gun for setting blind-rivet nuts as set forth in claim 1, wherein the air motor forward-/reverse rotation direction changeover mechanism comprises:

an air passage changeover spool in the gun body and having a front side;

a returning spring at the rear side of said air passage changeover spool; and a pushing spool at the front side of said changeover spool; and a spool air passage in said air passage changeover spool;

said air passage changeover spool being mounted to be moved by said returning spring in a direction to cause said spool air passage to communicate with a forward rotation side air passage of said air motor;

said air passage changeover spool being mounted to be retracted by said pushing spool to which a predetermined oil pressure is applied thereto when the oil piston is retracted, to cause said air passage to communicate with a reverse rotation side air passage of said air motor.

* * * * *